US005088782A

United States Patent [19]

Scott

[11] Patent Number: 5,088,782

[45] Date of Patent: Feb. 18, 1992

[54] CORN COB HOLDER AND METHOD

[76] Inventor: Douglas Scott, 7081 Great Oaks Rd., Germantown, Tenn. 38138

[21] Appl. No.: 661,423

[22] Filed: Feb. 26, 1991

[51] Int. Cl.[5] ..... A47G 21/00

[52] U.S. Cl. ..... 294/5; 294/61

[58] Field of Search ..... 294/1.1, 5, 5.5, 7, 294/26, 61; 30/124, 142, 147, 148, 164.5, 322, 346, 351, 353, 355; 81/3.48, 3.49; 99/419, 421 A; 426/91, 134; D7/642, 648, 649, 650, 653, 659, 683

[56] References Cited

U.S. PATENT DOCUMENTS

| | | | |
|---|---|---|---|
| Re. 9,687 | 5/1881 | Cox | 30/148 |
| D. 24,144 | 3/1895 | Harrison | 30/353 X |
| 187,363 | 2/1877 | Dixon | 294/5 |
| D. 268,723 | 11/1983 | Wolff | 294/5 X |
| 513,146 | 1/1894 | Richberg | 294/5 |
| 567,284 | 9/1896 | Stebbins | 294/5 |
| 770,104 | 9/1904 | Peters | 294/5 |
| 886,510 | 5/1908 | Huguet | 294/5 |
| 1,117,412 | 11/1914 | Lynch | 294/5 |
| 1,539,669 | 5/1925 | Hauser | 294/5 |
| 1,801,653 | 4/1931 | Berry | 294/5 |
| 1,991,871 | 2/1935 | Sindler | 294/61 |
| 2,275,536 | 3/1942 | Maisto | 294/5 |
| 2,612,687 | 10/1952 | Burch | 30/346 |
| 4,141,578 | 2/1979 | Zinder | 294/61 |

*Primary Examiner*—Johnny D. Cherry
*Attorney, Agent, or Firm*—Richard P. Crowley

[57] ABSTRACT

A corn cob holder and method, which holder comprises a handle adapted to be grasped by a user, an elongated, pointed penetrating element to penetrate the soft, inner pith of the corn cob to be held, and between the handle and penetrating element, a pair of upwardly curved retainer sections each having a knife-like edge and the retainer section of sufficient width so as to permit the knife-like edges to cut into the inner surface of the woody ring of lignified conducting tissue of the corn cob surrounding the inner pith so as to retain the corn cob holder in a secured holding position.

8 Claims, 3 Drawing Sheets

CORN COB HOLDER AND METHOD

BACKGROUND OF THE INVENTION

Corn on the cob, after cooking, is typically eaten either solely by hand, that is, by the user grasping each end of the corn cob, or more typically, by the aid and use of corn cob holders which are inserted into the one tip end and the other butt end of the corn cob in a secured fashion which enables the user to grasp such holders while eating the kernels off the corn cob.

There have been numerous corn cob holders suggested. In particular, those corn cob holders presented commercially available include a plastic handled corn cob holder with two protruding metal prongs which are inserted into each end of the corn cob. Another commercial model currently available includes a corn cob holder with wooden handles and featuring a small flat metal pointer for insertion into the corn cob. Other corn cob holders merely comprise a pointed stick which is inserted into the end of the corn cob. Corn cob holders should provide for the secure retention of the corn cob holder in each end of the corn cob so as to prevent rotation of the corn cob during eating and to provide a sufficient surface area of the handle so that the corn cob holder may be securely grasped.

Typically corn cob holders containing a pointed barb for insertion into the end of the corn cob are descried for example in U.S. Pat. No. 187,363 issued Feb. 13, 1877, U.S. Pat. No. 513,146 issued Jan. 23, 1894, U.S. Pat. No. 1,117,412 issued Nov. 17, 1914, and U.S. Pat. No. 1,539,669 issued May 26, 1925. Corn cob holders which contain helical screws or barb arrangements are described in U.S. Pat. No. 1,801,653 issued Apr. 21, 1931 and U.S. Design Pat. No. 268,723 issued Apr. 26, 1983. U.S. Pat. No. 2,227,536 issued Mar. 10, 1942 describes a diamond-type penetrating barb secured to heat-radiating webs and with a handle for holder hot vegetables.

It is desirable to provide for a corn cob holder and method in which the corn cob holder will easily penetrate the corn cob and yet hold the corn cob in a firm, secure, non-rotatable position during eating, and yet which corn cob holder is easily manufactured and effectively used.

SUMMARY OF THE INVENTION

The invention relates to a corn cob holder and method of using the corn cob holder. In particular, the invention concerns a plastic, inexpensive, easily manufactured corn cob holder having a knife edge retaining section which cuts into the inner surface of the woody ring of lignified conducting tissue about the soft, inner pith of the corn cob.

The corn cob holder of the invention comprises a handle which is adapted to be grasped by a user and which handle typically comprises a thin, flat handle having a flat surface such that advertising or other indicia or designs may be printed thereon on one or both sides, for example, to identify the source or origin of manufacturer or for promotional means, and which handle has a one and an other end, and typically is composed of a hard, injection molded plastic-type material. The corn cob holder also includes an elongated, pointed penetrating element, typically a thin, flat blade having a knife-like edge, or a serrated edge adapted to penetrate the soft, inner pith of the corn cob to be held.

The corn cob holder also includes between the handle and the penetrating element a corn cob retainer which includes an upwardly curved section having a knife-like or serrated-type edge, and which at one end is of sufficient width to cut into the inner surface of the woody ring of the lignified conducting tissue of the corn cob surrounding the inner pith so as to retain the corn cob holder in a secure position.

In one embodiment, the retaining section may comprise generally a steeply, upwardly curved or tapered-type knife edge section extending from one end of the penetrating element through the one end of the handle and a tapered knife edge on either side of the penetrating element. When the handle is grasped by the user and the penetrating element pushed into the soft, inner pith, further pushing of the handle inwardly into the corn cob causes the upwardly curved knife edge on each side of the retainer to engage and cut into the hard, woody ring of lignified conducting tissue.

In another embodiment, the retaining section comprises a generally circular or oval-shaped flat section with the general width at its maximum axis sufficient to cut into the inner surface of the woody ring and having an upwardly curved knife or serrated edges on the oval or circular section extending generally toward the penetrating element. After the penetrating element penetrates the soft, inner pith, the further pushing of the handle inwardly permits the forward, upward edge section of the oval or circular retaining section to cut into the inner surface of woody ring thereby securing the corn cob holder securely in position and to prevent rotation thereof. The corn cob holder may have a knife edge on both sides of the flat penetrating element and also on either side of the retaining section or the retaining section may merely have a knife-like edge, since a knife-like or serrated edge may not be required of the penetrating point to insure penetration of the soft, inner pith.

The corn cob holder of the invention may be made of a variety of materials, such as of wholly or partially of metal, wood, plastic and typically and preferably due to cost and ease of manufacture may comprise a wholly, unitary, integrally injection molded plastic holder composed of a generally flat handle, a flat retaining section and a flat, pointed penetrating section. The corn cob holder of the invention is adapted to be employed by pushing the penetrating element into the butt and tip ends of a corn cob into the inner pith, and by further pushing to engage the opposing knife edges of the retaining section into the inner surface of the woody ring of lignified conducting tissue surrounding the inner pith of the corn cob, so as to engage securely the corn cob holders at each end of the corn cob whereby the user may then grasp the flat handle sections for use in eating the corn kernels. While the corn cob holder is being described in particularly in connection with a corn cob, it is recognized that such holder may also have utility in connection with holding other food products, such as vegetables or fruits, wherein it is desired to hold the product with a handle and wherein the product has soft center and a woody ring surrounding the center, so that the knife edge of the retaining section of the holder may be firmly engaged.

The corn cob holder of the invention provides for a unique and secure holder and method to retain a corn cob. The corn cob typically comprises a generally elongated, conical food product having a butt end and tip end, and wherein the corn cob has an inner pith or soft core surrounded by a woody ring of lignified conducting tissue to which the multiple kernels of the corn cob are secured. Typically, for example, a corn cob may have a length of for example if trimmed at each end of five inches, e.g. four to ten inches, and a width at the tip end of one and one-quarter inches, e.g. one to one and one-half inches, and at the butt end of a width of two inches, e.g. one and one-half to two and one-quarter inches, and would then have a slightly conical inner pith extending from the one to the other end of about three-eighths inches at the butt end and three-sixteenths inches at the tip end. It has been found that even when the corn cob is cooked, the woody ring remains quite hard, and in some phases is even harder than prior to cooking. The soft, inner pith core is easily penetrated by a penetrating element as employed in the past. However, the prior art corn cob holders did not permit adequate cutting and securing to the surface of the woody ring, and thus would tend to rotate or become lose within the soft, inner pith core of the corn cob.

Thus, the corn cob holder of the invention provides for a penetrating element to penetrate the inner pith core, and further to secure contact with the woody rim from the inside by slight cutting of the rim to prevent rotation of the corn cob on the corn cob holder. A curved or tapered retaining section of the corn cob holder, together with the integrally formed penetrating element, makes it easy to penetrate the inner pith core and ultimately, by further inward pushing on the handle, to engage and penetrate the inner surface of the outer woody ring with the knife or serrated edge of the retaining section generally running from one end of either side of the flat penetrating blade or element upwardly, in one embodiment generally to the top of one end of the handle or in the other embodiment to the top of the oval or circle which is placed between the penetrating element and the handle. The corn cob holder, once in place, prevents rotation of the corn cob on its axis while in use. Further, the tapered or curved retaining section incorporates various diameters of corn cob cores, even those which might occur in a single ear of corn. The basic design is a unitary, injection molded, penetrating, retaining and flat handle which make possible easy fabrication in volume production in an injection molding machine wherein a throw away corn cob model becomes possible while the flat surface on either side of the handle lends itself to the employment of logos or printed indicia for commercial or advertising purposes. If desired, the flat handle section may contain a generally circular or oval hole therein as a finger hole, generally centrally positioned, to assist in removing the corn cob holder from each end of the corn cob after use.

The invention will be described for the purposes of illustration only in connection with certain embodiments; however, it is recognized that various changes, modifications, additions and improvements to the illustrated embodiments may be made by those persons skilled in art all falling within the spirit and scope of the invention.

DESCRIPTION OF THE EMBODIMENTS

Figure 1:
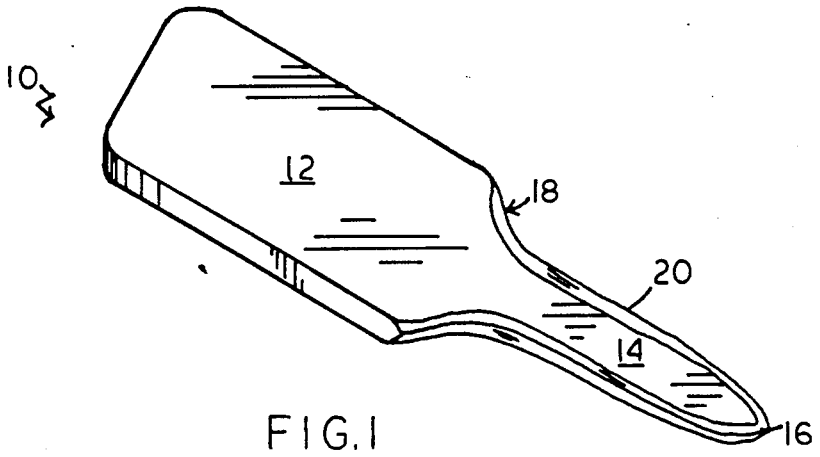
FIG. 1 is a perspective view from above of the corn cob holder of the invention.
Figure 2:
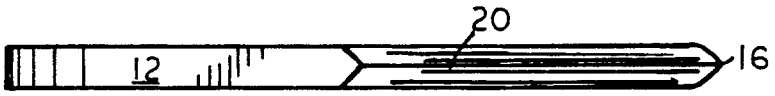
FIG. 2 is a side plan view of the holder of FIG. 1, the other side being the same.
Figure 3:
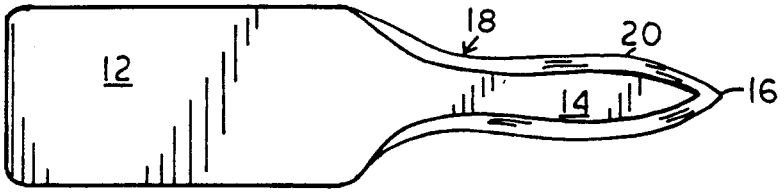
FIG. 3 is a bottom plan view of the holder of FIG. 1, the top plan view being the same.
Figure 4:
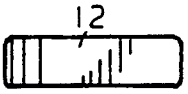
FIG. 4 is an end view of the holder of FIG. 1.
Figure 5:
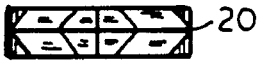
FIG. 5 is the other end view of the holder of FIG. 1.
Figure 6:
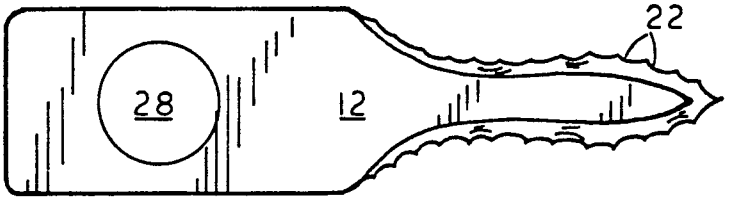
FIG. 6 is a bottom plan view of a modified holder of FIG. 1, the top plan view being the same.
Figure 7:
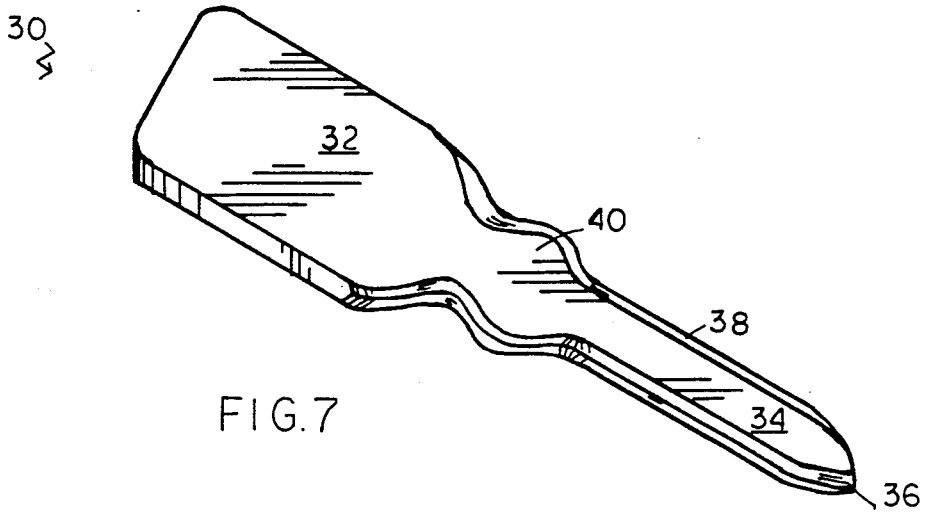
FIG. 7 is a perspective view of another embodiment of the a corn cob holder of the invention.
Figure 8:
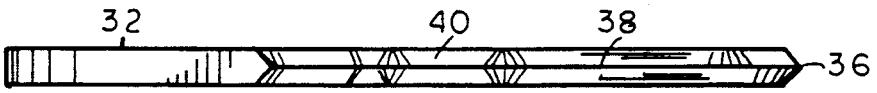
FIG. 8 is a side plan view of the holder of FIG. 7, the other side being the same.
Figure 9:
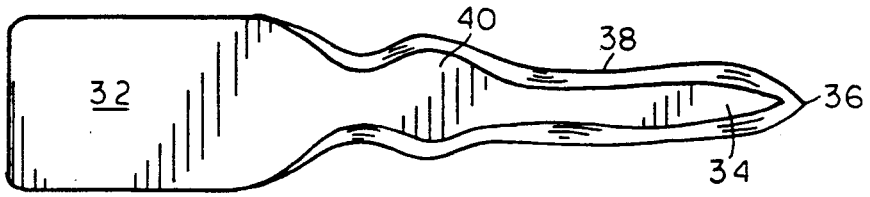
FIG. 9 is a bottom plan view of the holder of FIG. 7, the top plan view being the same.
Figure 10:
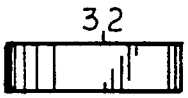
FIG. 10 is an end view of the holder of FIG. 7.
Figure 11:
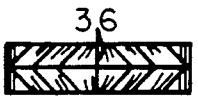
FIG. 11 is the other end view of the holder of FIG. 7.

FIGS. 1–5 are directed to a unitary, injection molded polystyrene corn cob holder 10 comprised of a flat handle section 12, an elongated penetrating section 14 having a point 16, and a curved retaining section 18 which extends from one end of the handle section upwardly to the other end of the penetrating section and having a knife edge 20. As illustrated, the knife edge extends along both the penetrating section 14 and upwardly to the retaining section 18. However, it is recognized that only the retaining section 18 need have a knife-like edge for penetrating the woody rim. In one example, for example, the penetrating section 14 may have a width of one-eighth or one-quarter inches while the retaining section may have a curved or tapered section which extends to a handle of seven-sixteenths to three-quarters inches, which is sufficient to permit penetration and cutting of the inner surface of the woody rim. It is of course recognized that the handle section need not be rectangular as shown, bu may be circular or oval, and may in fact have a hole therein to permit removal if desired. For example, the corn cob holder 10 may have a thickness about one-eighth inches and extend for example about one to two inches in front of the penetrating section 14. FIG. 6 shows a corn cob holder like the holder of FIGS. 1–5 except that the knife edge has been made a serrated edge 22 and contains a circular finger hole 28 in handle 12.

Figure 12:
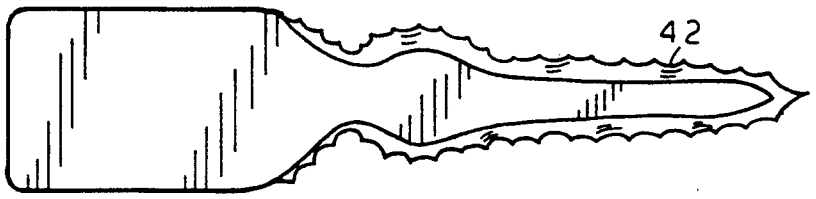
FIG. 12 is a bottom plan view of the modified holder of FIG. 7, the top plan view being the same.

FIGS. 7–11 are directed to another embodiment of a unitary, integrally injection molded corn cob holder 30 of the invention having a flat handle section 32, and flat elongated penetrating section 34 with a pointed end 36, and having a retaining section 40 in the general shape of an ellipse or an oval with the edge of the retaining section 40 and the penetrating section 34 having a knife edge 38 on both sides. Although as described, only the forward edge of the retaining section need have the knife edge for cutting the inner woody ring. FIG. 12 shows the corn cob holder having a serrated section 42 in place of the knife edge, which serrated section may be required only be in the upward curve of the retaining section 40 on either side.

Figure 13:
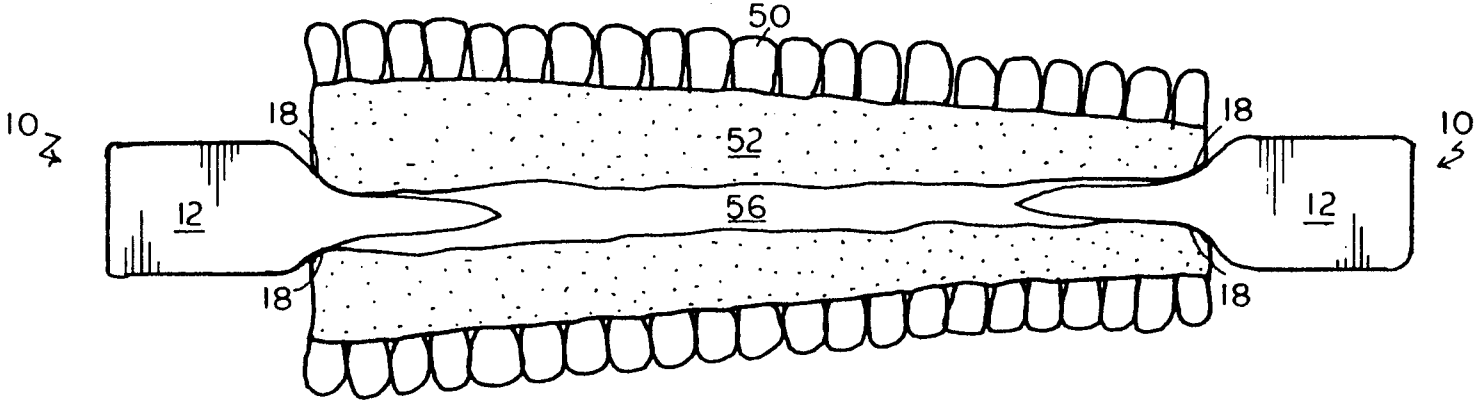
FIG. 13 is a schematic, illustrative, sectional view of the corn cob, holder of FIGS. 1–5 in use within a corn cob.
Figure 14:
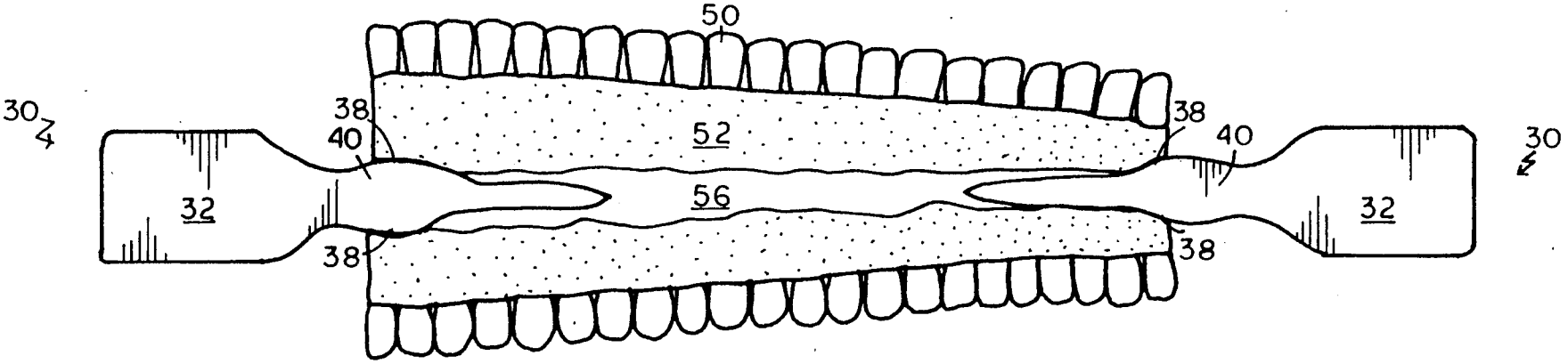
FIG. 14 is a schematic, illustrative, sectional view of the corn cob holder of FIGS. 7–11 employed in a corn cob.

FIGS. 13 and 14 are schematic, illustrative, sectional views showing the embodiments of the corn cob holder 10 and 30 employed in position within a corn cob, the corn cob having a plurality of outer kernels 50 and an inner woody ring of lignified conducting tissue 52 surrounding an elongated, conical, inner pith section 56.

As illustrated, the corn cob holder 10 is engaged in both the butt and tip ends of the corn cob with the knife edge 20 of the retaining section 18 cut into the inner surface of the woody ring, while the penetrating section 14 has penetrated the soft, inner pith and with the handle exposed to be grasped by the user. FIG. 14 shows the illustration of the corn cob holder 30 wherein the forward and top sections of a retaining section 40 with the knife edge 38 are engaging the inner surface of the woody ring, while the penetrating section 34 and its point 36 are engaged within the inner pith with the handle extending outwardly and adapted to be grasped by the user.

As described and illustrated, the corn cob holder and method provide an effective, secure, easily manufactured, non-rotatable corn cob holder of the invention.

What is claimed is:

1. A corn cob holder for use with and to retain in a secure, non-rotatable position, an ear of corn having a one and an other end and having outer kernels and a soft inner pith surrounded by a woody ring of lignified tissue, which corn holder comprises:

a) handle means having a one and other end and adapted to be grasped by a user;

b) a penetrating means to penetrate the soft inner pith of the corn cob and having one end and an other end, one end having a sharp point and the penetrating means having substantially parallel sides extending from the one end to the other end; and c) a generally oval-shaped retaining means integral with and between the other end of the penetrating means and the one end of the handle means the oval-shaped mans, having a major and minor axis and extending substantially outward from the parallel sides of the penetrating means, the major axis generally aligned with the axis of the penetrating means, the oval-shaped retaining means having opposite knife-like edges, and the minor axis having a width slightly greater than the diameter of the soft inner pith of the corn cob to be held whereby in use the user grasping the handle means inserts the penetrating means into the soft inner pith of the corn cob a sufficient distance so that the knife-like edges of the retaining means then cuts into the inner surface of the woody ring of the corn cob so as to retain the corn cob in a secure position.

2. The corn cob holder of claim 1 which comprises a unitary integrally molded plastic corn cob holder.

3. The corn cob holder of claim 1 where in the knife-like edges are serrated knife-like edges.

4. The corn cob holder of claim 1 wherein the handle means comprises a flat, generally rectangular-shaped handle.

5. The corn cob holder of claim 1 wherein the handle means includes an opening therein to assist in removing the corn cob holder after use.

6. The corn cob holder of claim 1 wherein the width of the minor axis of the retaining means is about three-eighths of an inch.

7. A corn cob having a butt and a tip end and the corn cob holder of claim 1 inserted int eh butt and tip end.

8. A corn cob holder for use with and to retain in a secure, non-rotatable position an ear of corn having a one and an other end and outer kernels, and a soft inner pith surrounded by a woody ring of lignified tissue, which corn cob holder comprises a unitary molded plastic corn cob holder having:

a) a flat handle means having a one and an outer end and adapted to be grasped by a user;

b) a penetrating means to penetrate the soft inner pith of the corn cob and having a one end and an other end, one end having a sharp point, and the penetrating means having substantially parallel sides extending from the one ed to the other end; and c) a generally flat, oval-shaped retaining means integral with and between the other end of the penetrating means and the one end of the handle means, the flat, oval-shaped means having a major and a minor axis and extending substantially outward from the parallel sides of the flat penetrating means, the major axis generally aligned with the axis of the penetrating means, the oval-shaped retaining means having opposite knife-like edges, and the minor axis having a width slightly greater than the diameter of the soft inner pith of the corn cob to be held whereby in use the user grasping the handle means inserts the penetrating means into the soft inner pith of the corn cob a sufficient distance so that the knife-like edges of the retaining means then cut into the inner surface of the woody ring of the corn cob so as to retain the corn cob in a secure position.

* * * * *